US008499736B2

(12) United States Patent
Taki

(10) Patent No.: US 8,499,736 B2
(45) Date of Patent: Aug. 6, 2013

(54) ENGINE FOR VEHICLE

(75) Inventor: Masafumi Taki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 842 days.

(21) Appl. No.: 12/508,120

(22) Filed: Jul. 23, 2009

(65) Prior Publication Data

US 2010/0050961 A1 Mar. 4, 2010

(30) Foreign Application Priority Data

Sep. 2, 2008 (JP) ..... 2008-225192

(51) Int. Cl.
*F02F 1/42* (2006.01)

(52) U.S. Cl.
USPC ..... 123/193.5; 123/195 R; 180/228

(58) Field of Classification Search
USPC ..... 180/339, 292, 68.6, 219, 225, 311, 180/228; 123/41.44, 41.1, 41.82 R, 195 R, 123/193.5; 248/674
IPC ..... F01P 7/14
See application file for complete search history.

(56) References Cited

U.S. PATENT DOCUMENTS

| | | | | |
|---|---|---|---|---|
| 5,803,219 | A * | 9/1998 | Ogawa | 192/21.5 |
| 6,637,539 | B2 * | 10/2003 | Rioux et al. | 180/339 |
| 2005/0218290 | A1 * | 10/2005 | Muramatsu | 248/674 |
| 2008/0066696 | A1 * | 3/2008 | Hirayama et al. | 123/41.44 |

FOREIGN PATENT DOCUMENTS

JP 2003-112677 A 4/2003

* cited by examiner

*Primary Examiner* — Noah Kamen
(74) *Attorney, Agent, or Firm* — Birch, Stewart, Kolasch & Birch, LLP

(57) ABSTRACT

A vehicle engine in which a water temperature sensor can be protected against debris or foreign matter such as earth and sand, flying stones, etc., from impacting the temperature sensor without taking any protective measure for exclusive use. A vehicle engine includes a head portion of the cylinder fitted with a water temperature sensor for detecting water temperature in a water jacket. The head portion of the cylinder is provided on one side thereof with a sensor mounting hole opening directly under an upstream end opening portion of an intake port. The water temperature sensor is mounted in the sensor mounting hole. Further, the head portion of the cylinder is formed with a left-right pair of hanger bosses which are opposed to each other, with the water temperature sensor therebetween. Engine hanger brackets extend from the body frame and are firmly attached to the hanger bosses.

20 Claims, 7 Drawing Sheets

ENGINE FOR VEHICLE

CROSS-REFERENCE TO RELATED APPLICATIONS

The present application claims priority under 35 USC 119 to Japanese Patent Application No. 2008-225192 filed on Sep. 2, 2008 the entire contents of which are hereby incorporated by reference.

BACKGROUND OF THE INVENTION

1. Field of the Invention

The present invention relates to a vehicle engine in which a cylinder is fitted with a water temperature sensor for detecting the temperature of water in a water jacket in the cylinder.

2. Description of Background Art

A vehicle engine is known, as disclosed, for example, in Japanese Patent Laid-Open No. 2003-112677 wherein the vehicle engine includes a water temperature sensor that is mounted to an upper surface of the cylinder which is disposed substantially horizontally, so that the distance from the ground surface to the water temperature sensor is comparatively short. Therefore, particularly in off-road vehicles such as buggies designed mainly for operating in an all terrain vehicle mode, the water temperature sensor is susceptible to flying debris or debris or foreign matter such as earth and sand, flying stones, etc. during the operation of the vehicle. In order to protect the water temperature sensor from such debris or foreign matter, it is necessary to take a protective measure, for example, covering the sensor with a protective cover for exclusive use. However, it is expensive to take protective measures in this way.

SUMMARY AND OBJECTS OF THE INVENTION

The present invention has been made in consideration of the above-mentioned circumstances. Accordingly, it is an object of an embodiment of the present invention to provide a vehicle engine in which a water temperature sensor can be protected against flying debris or foreign matter such as earth and sand, flying stones, etc., without providing any protective means for exclusive use.

According to an embodiment of the present invention a vehicle engine is mounted on a body frame with a cylinder set in a rising state. A head portion of the cylinder is provided with an intake port and an exhaust port which open into a combustion chamber inside the cylinder. The head portion is fitted with a water temperature sensor for detecting temperature of water in a water jacket in the cylinder with the head portion of the cylinder being provided on one side thereof with a sensor mounting hole opening directly under an upstream end opening portion of the intake port, the water temperature sensor is mounted in the sensor mounting hole, the head portion of the cylinder is further formed with a left-right pair of hanger bosses which are opposed to each other with the water temperature sensor therebetween. Engine hanger brackets extend from the body frame and are firmly attached to the hanger bosses.

The rising state of the cylinder provides a condition wherein the axis of the cylinder is set on a vertical line or the condition where the axis of the cylinder is slanted to the front side at such an angle that it is nearer to the vertical line than to a horizontal line.

In addition, the head portion of the cylinder corresponds to a cylinder head in an embodiment of the present invention described later, the hanger boss corresponds to a second hanger boss 52 in the embodiment, and the engine hanger bracket corresponds to a fourth engine hanger bracket 15D in the embodiment.

In addition, according to an embodiment of the present invention an intake tube portion having an end surface where the upstream end of the intake port is opened projects and is provided on one side of the head portion of the cylinder as the upstream end opening portion of the intake port. A mounting seat for firm contact with a fastening portion of the water temperature sensor mounted in the sensor mounting hole is formed at a lower portion of the intake tube portion with a cutout-like counter sinking being formed at a lower portion of the intake tube portion so that a part of the mounting seat ranges into the lower portion of the intake tube portion.

Further, according to an embodiment of the present invention the opening portions of the intake port and the exhaust port are laid out so that the center of a circle circumscribed on the circumferential edges of the opening portions has an offset from the axis of the cylinder toward the side opposite to the side of the water temperature sensor.

Furthermore, according to an embodiment of the present invention the pair of hanger bosses are united to each other through the intake tube portion.

According to an embodiment of the present invention, the water temperature sensor mounted to the head portion of the cylinder can detect the water temperature at a portion of the water jackets for the engine where temperature variations are comparatively large.

Moreover, since the water temperature sensor mounted to the head portion of the cylinder in the rising state is located at a high position of the engine, a collision on the sensor with debris or foreign matter such as flying stones, earth and sand, etc. coming from the lower side can be obviated as securely as possible. Further, since the water temperature sensor is disposed directly under the upstream end opening portion of the intake port, a collision on the sensor with debris or foreign matter coming from the upper side can be prevented by the throttle body connected to the upstream side of the intake port. Furthermore, since the head portion of the cylinder is provided with the left-right pair of hanger bosses opposed to each other with the water temperature sensor therebetween, the collision on the sensor with debris or foreign matter coming from the left or right outer side can be prevented by the hanger bosses and the engine hanger brackets firmly attached thereto. Thus, the collision on the water temperature sensor with debris or foreign matter flying from the surroundings can be obviated without arranging any protective cover for exclusive use. This can contribute to ensuring the durability of the water temperature sensor and to reducing the cost.

According to an embodiment of the present invention, the cutout-like counter sinking is formed at a lower portion of the intake tube portion so that a part of the mounting seat ranges into the lower portion of the intake tube portion. This ensures that a sufficiently broad mounting seat for fastening the water temperature sensor can be secured at the cylinder wall directly under the intake tube portion, which makes it possible to mount the water temperature sensor assuredly and to raise the layout position of the water temperature sensor as much as possible.

According to an embodiment of the present invention, the opening portions of the intake and exhaust ports into the combustion chamber are so laid out that they as a whole are somewhat deviated toward the side opposite to the side of the water temperature sensor, within the combustion chamber. As a result, the spacing between the opening potions of the intake port into the combustion chamber and the water temperature sensor is broadened, so that the internal volume of the water jacket arranged therebetween can be set large. Accordingly, cooling water in the water jacket can be prevented from stagnating around the water temperature sensor, and accurate detection of water temperature can be achieved.

According to an embodiment of the present invention, the left and right engine hanger bosses can be reinforced by the intake tube portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Now, a mode for carrying out the present invention will be described below, based on a preferred embodiment shown in the accompanying drawings.

Figure 1:
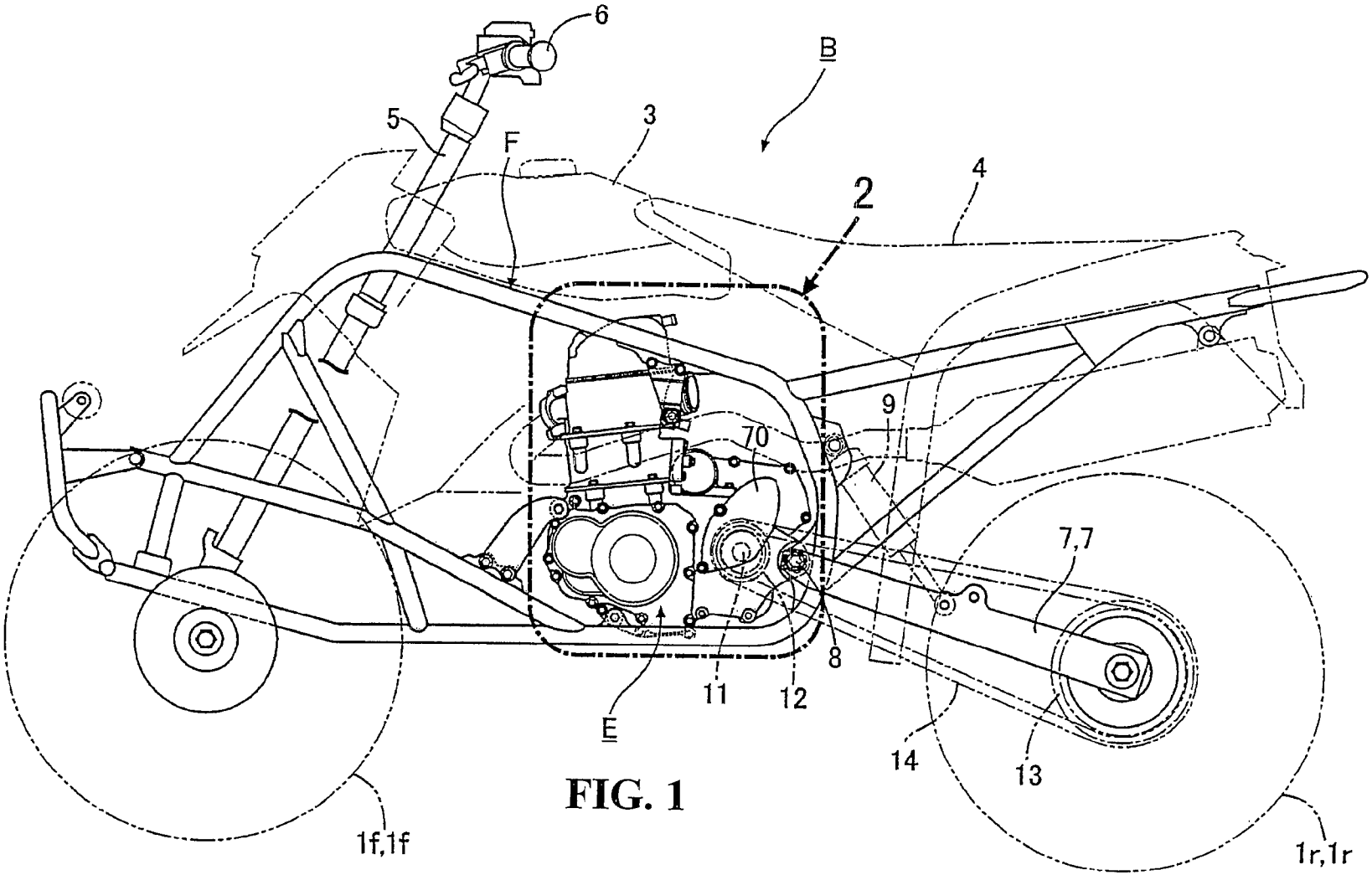
FIG. 1 is a side view of a four-wheel buggy according to an embodiment of the present invention.

FIG. 1 illustrates a four-wheel buggy B configured as a saddle ride type vehicle in which a left-right pair of front wheels 1*f*, 1*f* are suspended from front portions of a body frame F, a left-right pair of rear wheels 1*r*, 1*r* are suspended on the rear side thereof and an engine E is mounted on a central portion of the body frame F, with its crankshaft 2 directed in the left-right direction of the vehicle. A fuel tank 3 is mounted to an upper front portion of the body frame F with a saddle 4 being mounted on the rear side thereof. In addition, a bar-type steering handle 6 for steering the front wheels 1*f*, 1*f* is rotatably supported on a head pipe 5 fixedly provided at a front end portion of the body frame F.

A left-right pair of rear forks 7, 7 are vertically swingably connected to the body frame F and the engine E through a pivot shaft 8. The rear wheels 1*r*, 1*r* are rotatably supported on rear end portions of the rear forks 7, 7, and a rear shock absorber 9 is mounted between each of the rear forks 7, 7 and the body frame F. In this manner, the rear wheels 1*r*, 1*r* are suspended from the body frame F.

The engine E has an output shaft 11 projecting from a left side surface of a rear portion thereof, and a drive sprocket 12 is firmly attached to the outer end of the output shaft 11. A transmission chain 14 is wrapped around the drive sprocket 12 and a driven sprocket 13 which is firmly attached to a hub of the rear wheel 1*r* on the left side, correspondingly to the drive sprocket 12. The rear wheels 1*r*, 1*r* are driven through these components.

Figure 2:
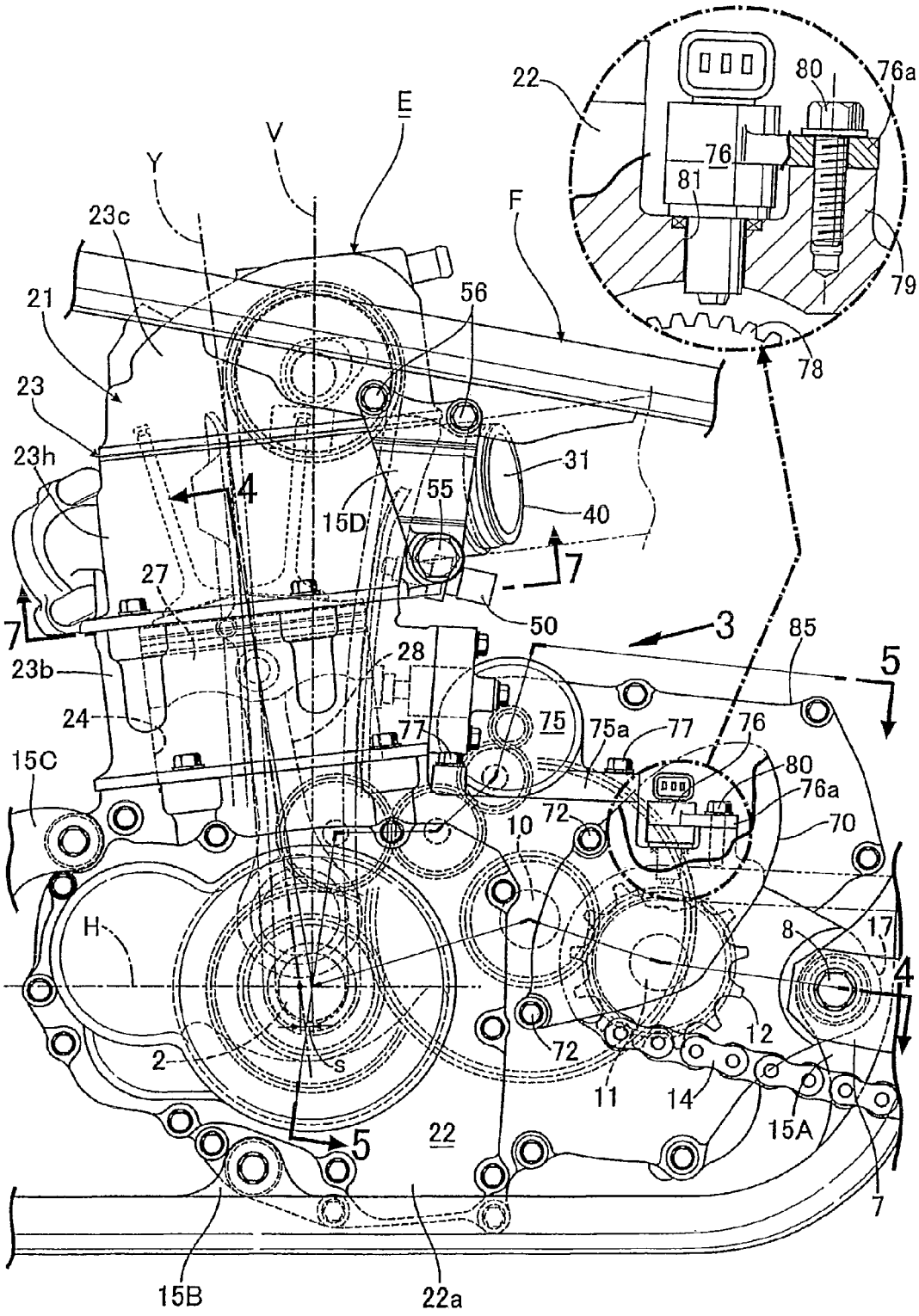
FIG. 2 is an enlarged view of a part 2 of FIG. 1.

In FIG. 2, the body frame F is provided with pairs of first to fourth engine hanger brackets 15A, 15A to 15D, 15D which are disposed respectively facing both left and right side surfaces of the engine E. The first engine hanger brackets 15A, 15A participate in supporting a rear end portion of the engine E and the rear forks 7, 7; the second engine hanger brackets 15B, 15B engage in supporting a somewhat-front lower portion of the engine E; the third engine hanger brackets 15C, 15C participate in supporting a front end portion of the engine E; and the fourth engine hanger brackets 15D, 15D engage in supporting an upper portion of the engine E. The engine hanger brackets are connected to the engine E by use of bolts.

Figure 4:
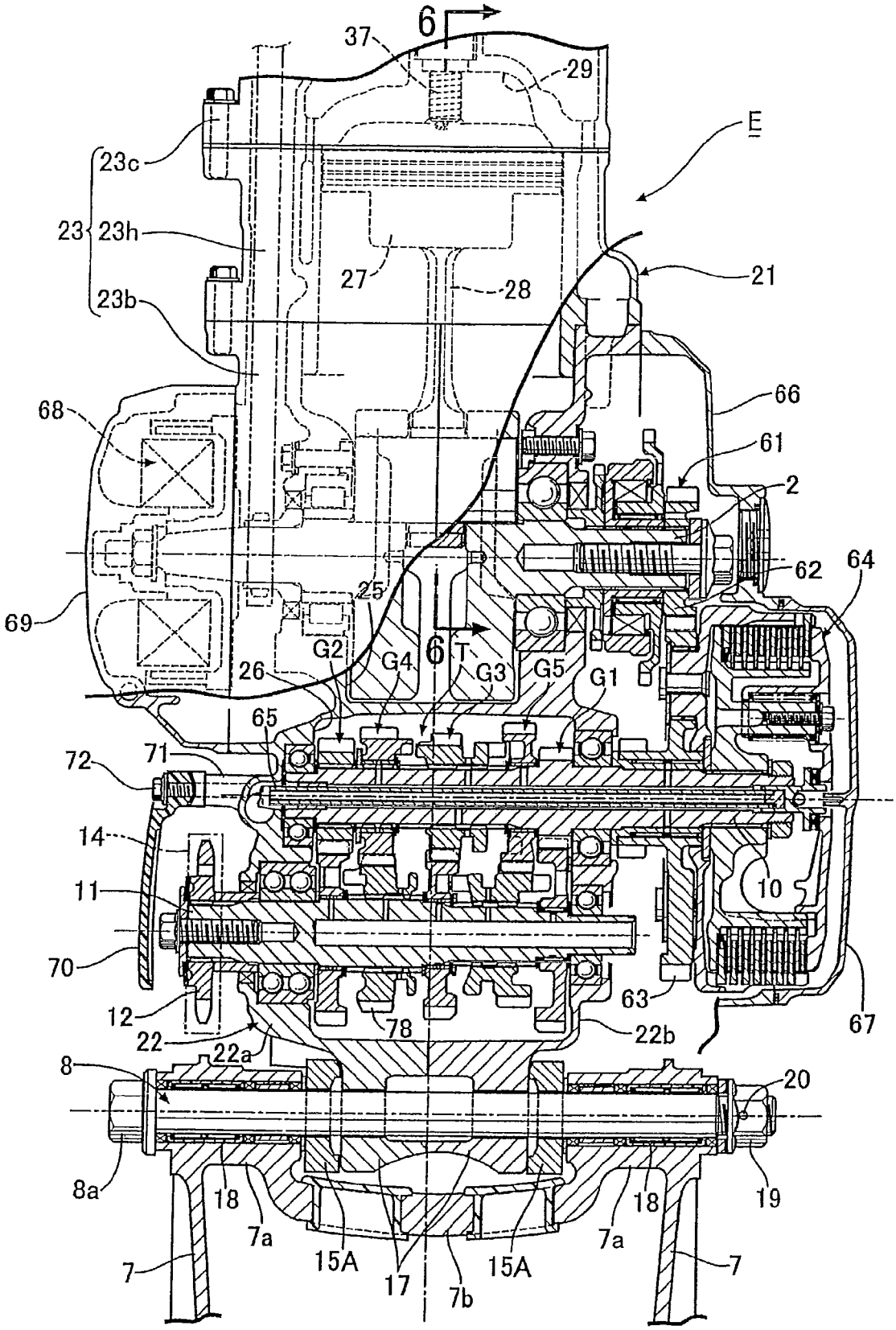
FIG. 4 is a sectional view taken along line 4-4 of FIG. 2.

Referring to FIGS. 2 and 4, items relating to support structure for the rear forks 7, 7 will be described in detail below.

A crankcase 22 of the engine E is integrally formed with a first hanger boss 17 projecting from a rear surface thereof. The pair of first engine hanger brackets 15A, 15A is disposed so as to clamp the first hanger boss 17 from the left and right sides. The pivot shaft 8 is passed through the first hanger boss 17 and the first engine hanger brackets 15A, 15A. The pivot shaft 8 has both its end portions extended outward beyond the left and right first engine hanger brackets 15A, 15A. Support bosses 7*a*, 7*a* at front end portions of the left-right pair of rear forks 7, 7 are supported on both the extended end portions of the pivot shaft 8 through needle bearings 18, 18. The pivot shaft 8 has at its one end a head portion 8*a* to be abutted on the outer end of the support boss 7*a* on one side, a nut 19 to be opposed to the outer end of the support boss 7*a* on the other side is screw engaged with the other end portion of the pivot shaft 8, and the nut 19 is fixed by a split pin 20. The left and right support bosses 7*a*, 7*a* are united to each other by a cross member 7*b*.

Thus, by the single pivot shaft 8, the first hanger boss 17 of the engine E and the first engine hanger brackets 15A, 15A of the body frame F are connected, and the left and right rear forks 7, 7 are swingably supported. In other words, the pivot shaft 8 plays two roles, i.e., the role of fixingly supporting the engine E onto the body frame F and the role of swingably supporting the rear forks 7, 7. In this manner, the pivot shaft 8 contributes to simplification of the structure. In addition, the rear forks 7, 7 are each supported by both the first hanger boss 17 and the first engine hanger bracket 15A through the pivot shaft 8, so that support rigidity thereof is enhanced.

Now, referring to FIGS. 2 to 4, the engine E will be described below.

The engine E is of a water-cooled 4-cycle system that includes an engine body 21, which is composed of the crankcase 22 and a cylinder 23 rising from a front portion of the crankcase 22. The crankcase 22 is composed of a left case half 22*a* and a right case half 22*b* which are formed individually and are bolt joined to each other at a vertical plane orthogonal to the axis of a crankshaft 2. The cylinder 23 is composed of a cylinder block 23*b* joined to an upper end surface of a front portion of the crankcase 22, a cylinder head 23*h* joined to the upper end of the cylinder block 23*b*, and a head cover 23*c* joined to the upper end of the cylinder head 23*h*. The rising of the cylinder 23 means the condition where the axis Y of the cylinder 23, or the center line of a cylinder bore 24, is set on a vertical line V or the condition where the axis Y is slanted to the front side at such an angle that it is nearer to the vertical line V than to a horizontal line H. The example shown in the drawings resides in the latter condition.

The interior of the crankcase 22 is partitioned into a crank chamber 25 directly under the cylinder 23, and a transmission chamber 26 aligned with and on the rear side of the crank chamber 25. The crank chamber 25 accommodates the crankshaft 2, while the transmission chamber 26 accommodates a multistage transmission T.

The cylinder block 23*b* is formed therein with a single cylinder bore 24, and a piston 27 fitted therein is connected to the crankshaft 2 through a connecting rod 28.

Figure 6:
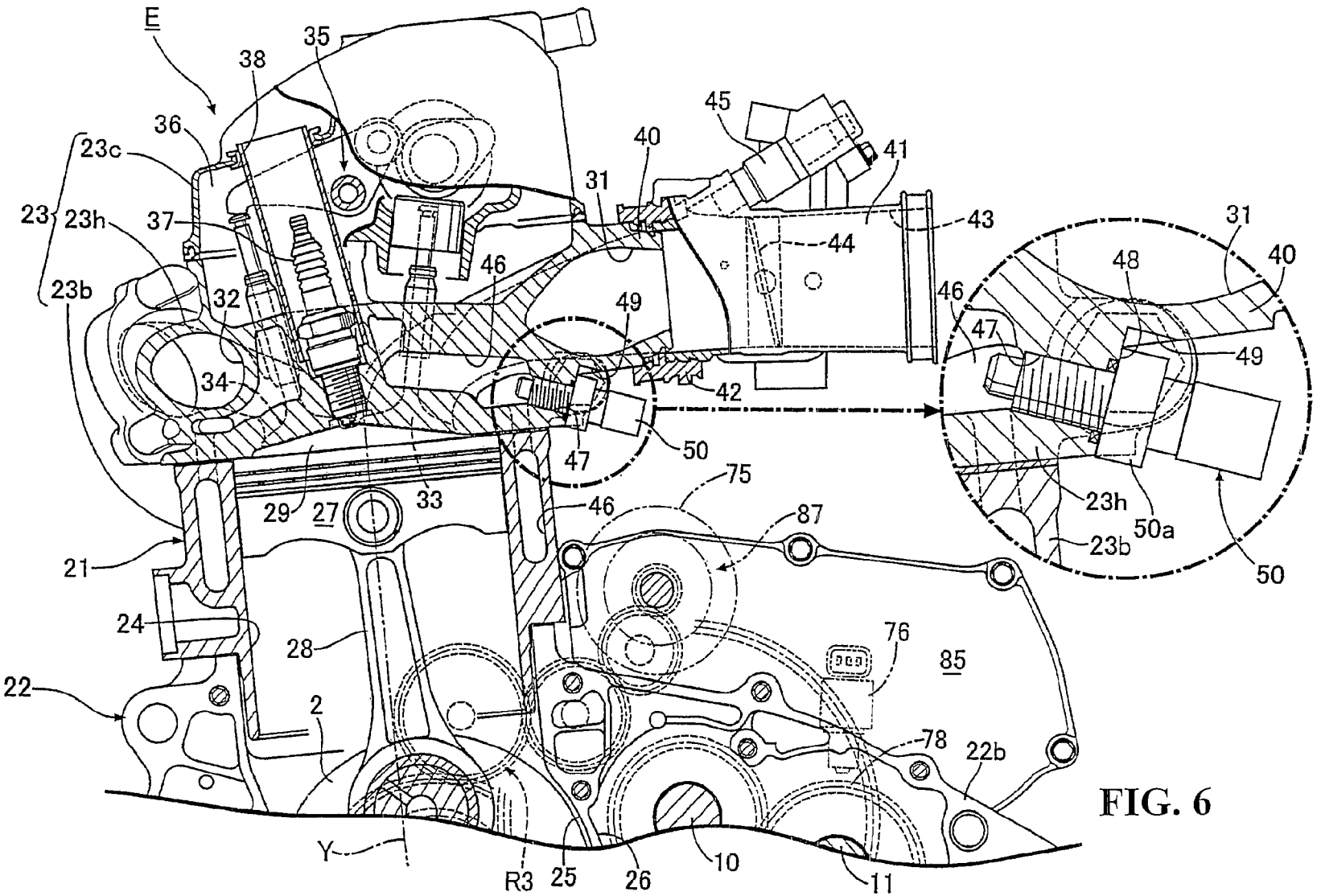
FIG. 6 is a sectional view taken along line 6-6 of FIG. 4.
Figure 7:
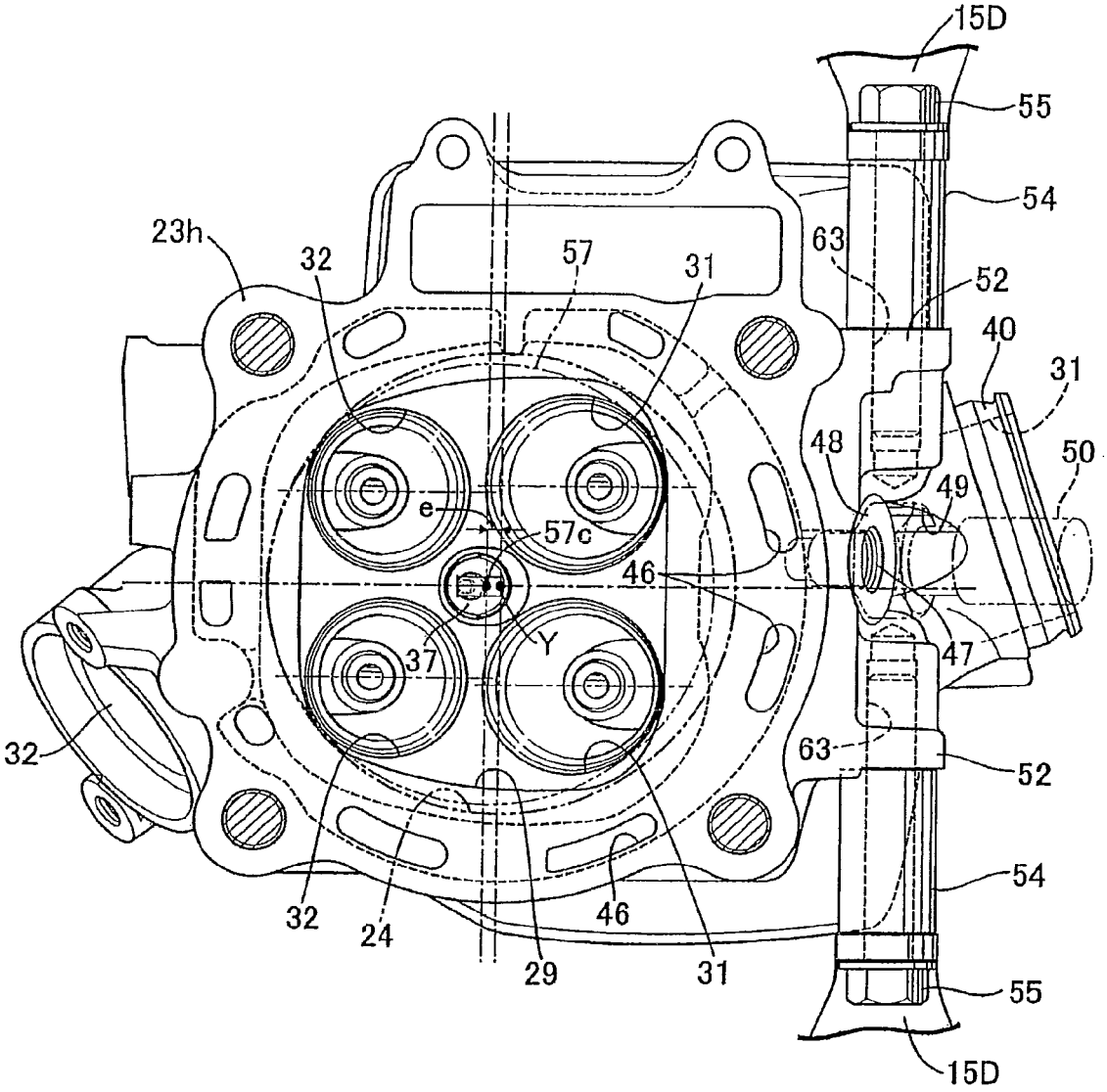
FIG. 7 is a sectional view taken along line 7-7 of FIG. 2.

In FIGS. 6 and 7, the cylinder head 23*h* is provided with a combustion chamber 29 communicating with the cylinder bore 24, and an intake port 31 and an exhaust port 32 which open into the combustion chamber 29. The intake and exhaust ports 31 and 32 are each bifurcated on the combustion chamber 29 side, before opening into the combustion chamber 29, and pairs of intake and exhaust valves 33 and 34 for opening/closing the opening ends are mounted to the cylinder head 23*h*. A valve system 35 for driving the intake and exhaust valves 33, 34 to open and close is arranged in a valve system chamber 36 defined between the cylinder head 23*h* and the head cover 23*c*.

A spark plug 37 is screw engaged to the cylinder head 23*h*, with its electrode fronting on that central zone of the combustion chamber 29 which is surrounded by the intake and exhaust valves 33, 34. The spark plug 37 is contained in a tubular plug guide 38, which penetrates the valve system chamber 36 vertically and is mounted to the cylinder head 23*h* and the head cover 23*c*.

The upstream end of the intake port 31 opens at an end face of an intake tube portion 40 integrally projectingly provided at a rear surface of the cylinder head 23*h*, and a throttle body 41 is connected to the intake tube portion 40 through an insulator ring 42. A throttle valve 44 for opening/closing an intake duct 43 continuous with the intake port 31, and a fuel injection valve 45 for injecting a fuel toward the intake pot 31, are mounted to the throttle body 41.

The cylinder block 23*b* and the cylinder head 23*h* are equipped with a series of water jackets 46. A rear wall of the cylinder head 23*h* just under the intake tube portion 40 is provided with a first sensor mounting hole 47 penetrating the rear wall in the front-rear direction to reach the water jacket 46, and with a mounting seat 48 at which the outer end of the first sensor mounting hole 47 opens. In this case, the intake tube portion 40 is provided at its lower portion with a cutout-like counter sinking 49 so that a part of the mounting seat 48 ranges into the lower portion of the intake tube portion 40. A water temperature sensor 50 for detecting the temperature of water in the water jackets 46 is screw fitted into the first sensor mounting hole 47, and a fastening portion 50*a* thereof is put in firm contact with the mounting seat 48.

The water temperature sensor 50 mounted to the cylinder head 23*h* detects the water temperature in the cylinder head 23*h*, where temperature variations are comparatively large, among the water jackets 46 for the engine E, and sends a detection signal to an electronic control unit for controlling a fuel injection system, an ignition system and the like. Therefore, the fuel injection system, the ignition system and the like can be appropriately controlled in quick response to variations in the engine temperature. Moreover, since the water temperature sensor 50 mounted to the cylinder head 23*h* of the cylinder 23 set in the rising state is located at a high position of the engine E, debris or foreign matter such as stones, earth and sand, etc. that may fly from the lower side to the water temperature sensor 50 can be obviated as securely as possible.

In addition, the water temperature sensor 50 disposed directly under the intake tube portion 40 can be protected against contact therewith of debris or foreign matter coming from the upper side, by the intake tube portion 40 and the throttle body 41 connected thereto.

Further, the intake tube portion 40 is provided at its lower portion with the cutout-like counter sinking 49 so that a part of the mounting seat 48 ranges into the lower portion of the intake tube portion 40. As a result, a sufficiently broad mounting seat 48 for fastening the water temperature sensor 50 can be secured at the rear wall of the cylinder head 23*h* just under the intake tube portion 40, so that the water temperature sensor 50 can be attached assuredly, and the layout position of the water temperature sensor 50 can be raised as much as possible.

Now, referring to FIGS. 3 and 7, a further protective structure for the water temperature sensor 50 will be described.

The rear wall of the cylinder head 23*h* is integrally formed with a left-right pair of second hanger bosses 52, 52 which are opposed to each other, with the water temperature sensor 50 therebetween. In this case, the left and right second hanger bosses 52, 52 are united to each other through the intake tube portion 40. With this structure, both the second hanger bosses 52, 52 are reinforced by the intake tube portion 40. The second hanger bosses 52, 52 are provided with screw holes opening at left and right outer end surfaces thereof. Lower end portions of the left-right pair of fourth engine hanger brackets 15D, 15D mentioned above are laid over the second hanger bosses 52, 52 through distance collars 54, 54, and are secured in situ by bolts 55, 55 engaged with the screw holes. In addition, upper end portions of the fourth engine hanger brackets 15D, 15D are firmly attached to the body frame F by bolts 56, 56. The fourth engine hanger brackets 15D, 15D may preliminarily be welded to the body frame F. However, the configuration in which they can be attached to and detached from the body frame F as above-mentioned is advantageous from the viewpoint of mounting of the engine E onto the body frame F.

Thus, the water temperature sensor 50 interposed between the left and right fourth engine hanger brackets 15D, 15D can be protected from debris or foreign matter that may collide thereon that may come from the left or right outer side, by the pair of second hanger bosses 52, 52 and the fourth engine hanger brackets 15D, 15D.

In the above-mentioned manner, the water temperature sensor 50 can be protected from externally flying debris or foreign matter, without arranging any protective cover for exclusive use. This can contribute to ensuring the durability of the water temperature sensor 50 and to a reduction in cost.

In addition, in the combustion chamber 29, the opening portions of the intake port 31 and the exhaust port 32 which are opened/closed respectively by the intake valves 33 and the exhaust valves 34 are so laid out that the center 57*c* of a circle 57 circumscribed on the circumferencial edges of the opening portions has an offset (e) from the axis Y toward the side opposite to the side of the water temperature sensor 50. In short, the opening portions of the intake and exhaust ports 31, 32 into the combustion chamber 29 are laid out so that they as a whole are somewhat deviated toward the side opposite to the side of the water temperature sensor 50, within the combustion chamber 29. This layout ensures that the spacing between the opening portions of the intake port 31 into the combustion chamber 29 and the water temperature sensor 50 is widened, so that the internal volume of the water jacket 46 arranged therebetween can be set large. Accordingly, cooling water in the water jacket 46 can be prevented from stagnating around the water temperature sensor 50, and accurate detection of water temperature can be achieved.

Now, referring to FIGS. 2 and 4, the multistage transmission T and the peripheral structure will be described below.

The multistage transmission T contained in the transmission chamber 26 of the crankcase 22 has an input shaft 10 and an output shaft 11 which are supported in parallel to the crankshaft 2 by the crankcase 22. The output shaft 11 is laid out on the rear side of the input shaft 10, and the input shaft 10 is laid out above the crankshaft 2 and the output shaft 11. Such a layout makes it possible to render the crankcase 22 compact in the front-rear direction. Thus, the size of the engine E is more compact. Moreover, as above-mentioned, the crankcase 22 is composed of the left case half 22*a* and the right case half 22*b* which are joined to each other at the vertical plane orthogonal to the axis of the crankshaft 2. When the left case half 22*a* and the right case half 22*b* are joined to each other, therefore, both ends of each of the above-mentioned three shafts can be easily supported by the case halves 22*a*, 22*b*.

The input shaft 10 and the crankshaft 2 have their right end portions projecting to the outside of the crankcase 22, and a primary transmission 61 is provided between the right end portions. The primary transmission 61 is composed of a small-diameter drive gear 62 secured to the crankshaft 2, and a large-diameter driven gear 63 rotatably supported on the input shaft 10 and meshed with the drive gear 62. In addition, a clutch 64 for disengageably coupling the driven gear 63 and the input shaft 10 is mounted to the input shaft 10. A push rod 65 which ensures interlocking between a clutch lever provided at the steering handle 6 and a release member of the clutch 64 is arranged in a hollow portion of the input shaft 10. With the push rod 65 advanced and retracted by operating the clutch lever, the clutch 64 is changed over between an ON state for connecting the driven gear 63 and the input shaft 10 to each other and an OFF state for disconnecting the driven gear 63 and the input shaft 10 from each other.

A side cover 66 for covering the primary transmission 61 and an outer circumferential portion of the clutch 64 is bolted to a right side surface of the crankcase 22. In addition, a clutch cover 67 for covering an outer end face of the clutch 64 is joined to the side cover 66.

Further, a left end portion of the crankshaft 2 also projects to the outside of the crankcase 22. A generator 68 driven by the crankshaft 2 is mounted between the left end portion and the crankcase 22. A generator cover 69 for covering the generator 68 is joined to a left outside surface of the crankcase 22.

The transmission T further includes first-speed to fifth-speed gear trains G1 to G5 arranged between the input shaft 10 and the output shaft 11, and an arbitrary one of the gear trains is selectively established.

The output shaft 11 has its one end portion projected to the left outer side of the crankcase 22, and the above-mentioned drive sprocket 12 is secured to the one end portion. In addition, a synthetic resin-made sprocket cover 70 for covering the drive sprocket 12 is secured by bolts 72 to a plurality of mounting bosses 71 that project from the left outside surface of the crankcase 22.

Figure 3:
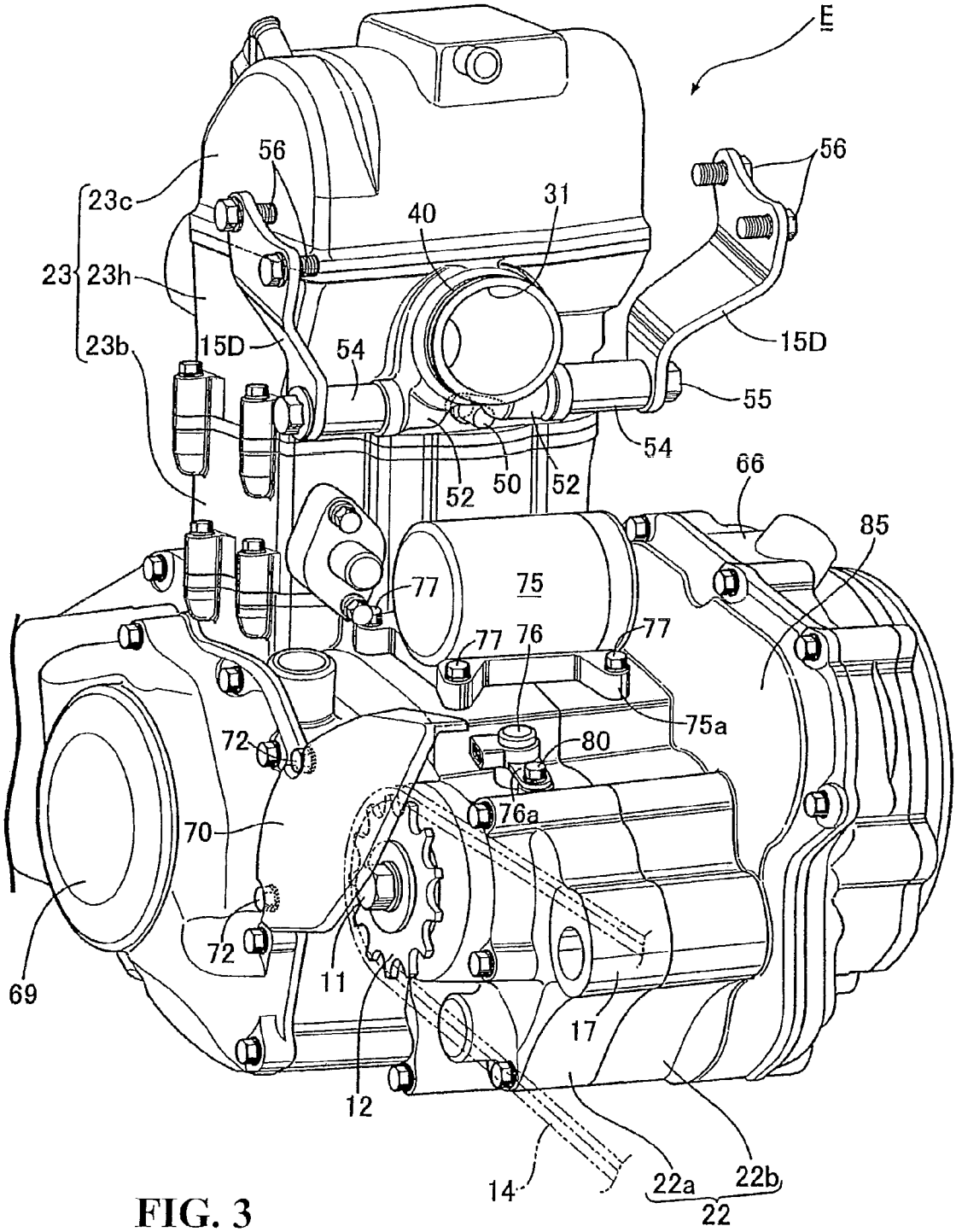
FIG. 3 is a perspective view of an engine shown in FIG. 2.
Figure 5:
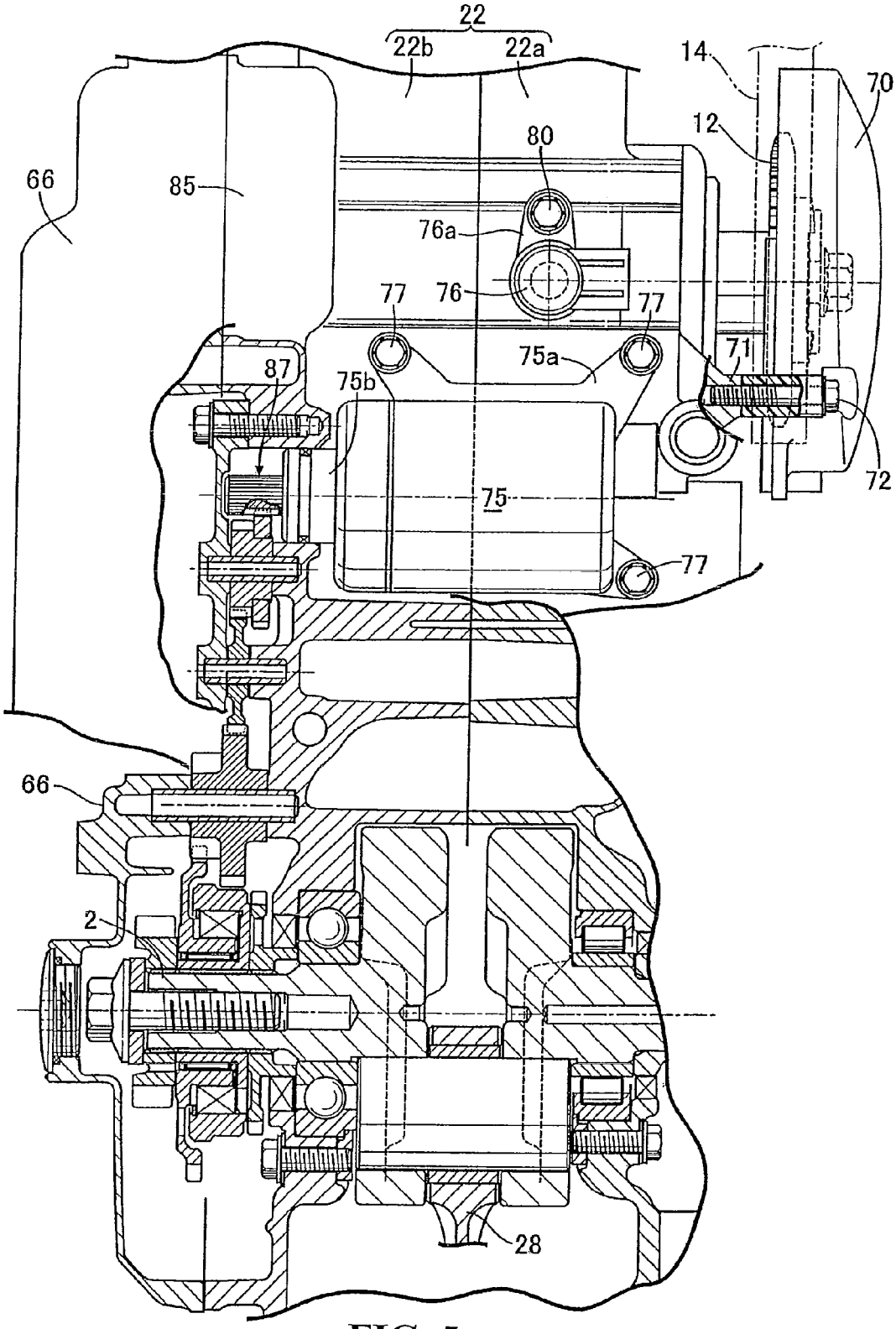
FIG. 5 is a sectional view taken along line 5-5 of FIG. 2.

As shown in FIGS. 2, 3 and 5, a starter motor 75 and a speed sensor 76 disposed just at the rear of the starter motor 75 are attached to an upper surface of the crankcase 22 projecting to the rear side of the cylinder 23. In addition, the cylinder 23 is so laid out that its axis Y has an offset of a predetermined distance (s) from the center of the crankshaft 2 toward the side opposite to the side of the starter motor 75. Such a layout of the cylinder 23 ensures that the upper surface, projecting to the rear side of the cylinder 23, of the crankcase 22 is broadened for facilitating the arrangement of the starter motor 75 and the speed sensor 76 onto the projecting upper surface.

As clearly shown in FIG. 2, on the upper surface of the crankcase 22, the starter motor 75 is arranged at a portion directly above the input shaft 10, while the speed sensor 76 is arranged at a portion directly above the output shaft 11. In addition, a mounting flange 75*a* of the starter motor 75 is secured to the crankcase 22 by bolts 77.

On the other hand, the speed sensor 76 is arranged so as to detect as the vehicle speed the rotating speed of a gear 78 which is provided on the output shaft 11 and rotated as one body with the output shaft 11, in the example shown, a driven gear 78 in the fourth-speed gear train G4. More specifically, a second sensor mounting hole 81 opening toward a tooth portion of the gear 78 is provided in an upper wall of the crankcase 22, and a mounting flange 76*a* is secured by a bolt 80 to a boss 79 projectingly provided at the upper surface of the crankcase 22 in the condition where the speed sensor 76 is fitted in the second sensor mounting hole 81 and a sensing portion at its tip is set close to the tooth portion of the gear 78.

At a right end portion of the crankcase 22, a raised wall 85 is formed which rises from the upper surface of the crankcase 22 and covers a right side surface of the speed sensor 76. The raised wall 85 constitutes a joining portion for the side cover 66, and a starting transmission 87 for transmitting a driving force of the starter motor 75 to the crankshaft 2 and, optionally, a kick starter mechanism or the like are contained in a space 86 between the raised wall 85 and the side cover 66.

In addition, the sprocket cover 70 has its upper end projecting to the upper side of the crankcase 22 that overlaps with at least a part of a left side surface of the speed sensor 76 in a side view.

Thus, the speed sensor 76 is covered and protected by the raised wall 85 and the sprocket cover 70 on both the left and right outer sides thereof, so that debris or foreign matter such as flying stones, earth and sand, etc. can be prevented from impacting with the speed sensor 76 from the left or right outer side.

Since the input shaft 10 is laid out above the crankshaft 2 and the output shaft 11 so as to render the crankcase 22 compact as above-mentioned, the upper surface of the crankcase 22 is narrow. However, since the starter motor 75 is laid out at a portion, just above the input shaft 10, of the upper surface of the crankcase 22 and the speed sensor 76 is laid out at a portion, just above the output shaft 11, of the upper surface of the crankshaft 22, the space efficiency for the layout is good, and an increase in the size of the engine E due to the arrangement of the starter motor 75 and the speed sensor 76 can be obviated.

In addition, since the speed sensor 76 disposed at a portion just above the output shaft 11 is spaced sufficiently from the cylinder 23, it is less liable to be influenced by the heat of the cylinder 23.

Further, the speed sensor 76 is protected also on both the left and right sides thereof by the raised wall 85 of the crankcase 22 and the sprocket cover 70, so that debris or foreign matter such as flying stones, earth and sand, etc. can be prevented from impacting with the speed sensor 76 from the left or right outer side.

In addition, since the speed sensor 76 is arranged on the upper surface of the crankcase 22, debris or foreign matter can be prevented from impacting with the speed sensor 76 from the rear side by the first hanger boss 17 projecting at the rear side of the crankcase 22 and by the left and right rear forks 7, 7 swingably supported on the first hanger boss 17 through the pivot shaft 8, as above-mentioned. Therefore, there is no need for a protective cover used exclusively for the speed sensor 76.

While an embodiment of the present invention has been described above, the invention is not limited to the above embodiment, and various design modifications are possible within the scope of the gist of the invention. For example, the present invention is applicable also to engines of other vehicles than the four-wheel buggy, such as motorcycles and motor tricycles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A vehicle engine mounted on a body frame comprising:

a cylinder set to project upwardly;

a head portion of said cylinder being provided with an intake port and an exhaust port opening into a combustion chamber inside said cylinder;

a sensor mounting hole being provided in said head portion on one side of said cylinder, said sensor mounting hole opening directly under an upstream end opening portion of said intake port;

a water temperature sensor for detecting temperature of water in a water jacket in said cylinder being mounted in said sensor mounting hole;

a left-right pair of hanger bosses being formed in said head portion of said cylinder, said left-right pair of hanger bosses being opposed to each other with said water temperature sensor therebetween; and left and right engine hanger brackets extending from said body frame, the left engine hanger being attached to said left hanger boss, and the right engine hanger being attached to said right hanger boss, wherein the water temperature sensor projects rearwardly.

2. The vehicle engine according to claim 1, wherein an intake tube portion having an end surface where the upstream end of said intake port is opened projects from one side of said head portion of said cylinder as said upstream end opening portion of said intake port, a mounting seat for firm contact with a fastening portion of said water temperature sensor mounted in said sensor mounting hole is formed at a lower portion of said intake tube portion, and a cutout-like counter sinking is formed at a lower portion of said intake tube portion so that a part of said mounting seat ranges into the lower portion of said intake tube portion.

3. The vehicle engine according to claim 2, wherein said left and right hanger bosses are united to each other through said intake tube portion of said head portion of said cylinder.

4. The vehicle engine according to claim 1, wherein opening portions of said intake port and said exhaust port are laid out so that the center of a circle circumscribed on the circumferential edges of said opening portions has an offset from the axis of said cylinder toward the side opposite to the side of said water temperature sensor.

5. The vehicle engine according to claim 4, wherein opening portions of the intake and exhaust ports into the combustion chamber are arranged to be deviated towards a side opposite to a side wherein the water temperature sensor is positioned relative to the combustion chamber.

6. The vehicle engine according to claim 5, wherein the offset ensures that the spacing between the opening portions of the intake port into the combustion chamber and the water temperature sensor is increased wherein an internal volume of the water jacket is enlarged.

7. The vehicle engine according to claim 6, wherein cooling water in the water jacket is prevented from stagnating around the water temperature sensor based on the increase in the internal volume of the water jacket for ensuring an accurate detection of water temperature.

8. The vehicle engine according to claim 1, wherein the mounting of the temperature sensor directly under the upstream end opening of said intake port protects the temperature sensor from debris from above.

9. The vehicle engine according to claim 1, wherein each of said left and right hanger bosses includes a screw hole formed therein, and said left engine hanger bracket is secured to the left hanger boss by a bolt, and said right engine hanger bracket is secured to the right hanger boss by another bolt.

10. The vehicle engine according to claim 1, wherein the water temperature sensor is protected from debris by the left and right hanger bosses and the left and right engine hanger brackets.

11. A sensor mounting hole for a vehicle engine comprising:

a head portion of a cylinder being provided with an intake port and an exhaust port opening into a combustion chamber inside said cylinder;

a sensor mounting hole being provided in said head portion on one side of said cylinder, said sensor mounting hole opening directly under an upstream end opening portion of said intake port;

a water temperature sensor for detecting temperature of water in a water jacket surrounding said cylinder, said water temperature sensor being fitted in said sensor mounting hole;

a left hanger boss being formed in said head portion of said cylinder;

a right hanger boss being formed in said head portion of said cylinder;

said left and right hanger bosses being opposed to each other with said water temperature sensor positioned therebetween; and a pair engine hanger brackets, one being attached to each of said left and right hanger bosses, wherein the water temperature sensor projects rearwardly.

12. The sensor mounting hole for a vehicle engine according to claim 11, wherein an intake tube portion having an end surface where the upstream end of said intake port is opened projects from one side of said head portion of said cylinder as said upstream end opening portion of said intake port, a mounting seat for firm contact with a fastening portion of said water temperature sensor mounted in said sensor mounting hole is formed at a lower portion of said intake tube portion, and a cutout-like counter sinking is formed at a lower portion of said intake tube portion so that a part of said mounting seat ranges into the lower portion of said intake tube portion.

13. The sensor mounting hole for a vehicle engine according to claim 12, wherein said left and right hanger bosses are united to each other through said intake tube portion of said head portion of said cylinder.

14. The sensor mounting hole for a vehicle engine according to claim 11, wherein opening portions of said intake port and said exhaust port are laid out so that the center of a circle circumscribed on the circumferential edges of said opening portions has an offset from the axis of said cylinder toward the side opposite to the side of said water temperature sensor.

15. The sensor mounting hole for a vehicle engine according to claim 14, wherein opening portions of the intake and exhaust ports into the combustion chamber are arranged to be deviated towards a side opposite to a side wherein the water temperature sensor is positioned relative to the combustion chamber.

16. The sensor mounting hole for a vehicle engine according to claim 15, wherein the offset ensures that the spacing between the opening portions of the intake port into the combustion chamber and the water temperature sensor is increased wherein an internal volume of the water jacket is enlarged.

17. The sensor mounting hole for a vehicle engine according to claim 16, wherein cooling water in the water jacket is prevented from stagnating around the water temperature sensor based on the increase in the internal volume of the water jacket for ensuring an accurate detection of water temperature.

18. The sensor mounting hole for a vehicle engine according to claim 11, wherein the mounting of the temperature sensor directly under the upstream end opening of said intake port protects the temperature sensor from debris from above.

19. The sensor mounting hole for a vehicle engine according to claim 11, wherein each of said left and right hanger bosses includes a screw hole formed therein, and the one engine hanger being secured to the left hanger boss by a bolt, and the other of engine hanger brackets being secured to the right hanger boss by another bolt.

20. The sensor mounting hole for a vehicle engine according to claim 11, wherein the water temperature sensor is protected from debris by the left and right hanger bosses and the left and right engine hanger brackets.

* * * * *